US006644651B2

(12) United States Patent
Allsup

(10) Patent No.: US 6,644,651 B2
(45) Date of Patent: Nov. 11, 2003

(54) CAPTURED BELT PATH SELECTION APPARATUS AND SYSTEM

(75) Inventor: Thomas A. Allsup, Dallas, TX (US)

(73) Assignee: Siemens Dematic Postal Automation, L.P., Arlington, TX (US)

( * ) Notice: Subject to any disclaimer, the term of this patent is extended or adjusted under 35 U.S.C. 154(b) by 0 days.

(21) Appl. No.: 10/059,499

(22) Filed: Jan. 29, 2002

(65) Prior Publication Data

US 2003/0136642 A1 Jul. 24, 2003

(51) Int. Cl.[7] ..... B65H 29/00

(52) U.S. Cl. ..... 271/184; 198/457.03; 271/225; 271/302; 271/9.13

(58) Field of Search ..... 198/457.03; 271/184, 271/225, 302, 303, 9.13

(56) References Cited

U.S. PATENT DOCUMENTS

| | | | | | |
|---|---|---|---|---|---|
| 2,941,654 | A | | 6/1960 | Falconer | 198/34 |
| 3,717,249 | A | * | 2/1973 | Faley | 209/552 |
| 3,724,657 | A | * | 4/1973 | Katagiri et al. | 271/301 |
| 5,083,769 | A | * | 1/1992 | Young, Jr. | 271/280 |
| 5,150,894 | A | * | 9/1992 | Ricciardi | 271/302 |
| 5,188,210 | A | | 2/1993 | Malow | 198/369 |
| 5,199,550 | A | | 4/1993 | Wachi et al. | 198/626.1 |
| 5,205,393 | A | | 4/1993 | Malow et al. | 198/369 |
| 5,536,002 | A | | 7/1996 | Yoshida et al. | 271/264 |
| 5,542,547 | A | * | 8/1996 | Ricciardi | 209/539 |
| 5,944,165 | A | | 8/1999 | Mannlein et al. | 198/442 |
| 5,979,891 | A | * | 11/1999 | Roux | 271/225 |
| 6,227,532 | B1 | * | 5/2001 | Bakoledis | 271/9.13 |

* cited by examiner

*Primary Examiner*—Joseph E. Valenza
*Assistant Examiner*—Richard Ridley
(74) *Attorney, Agent, or Firm*—Philip G. Meyers

(57) ABSTRACT

A captured belt path selection device includes a first fixed frame including a plurality of fixed, vertically oriented belts mounted thereon and a second moveable frame including a plurality of vertically oriented movable selector belts and guide rollers mounted thereon, the moveable frame being positioned adjacent to and over the fixed frame, the moveable selector belts and guide rollers being vertically offset from the fixed belts so that the moveable belts and guide rollers pass above and below at least a portion of a fixed belt as the second frame is moved from a first position to a second position. At least a first one of the moveable belts and a fixed belt transport media therebetween along a first path when the moveable, frame is in a first position and at least a second one of the moveable belts and a fixed belt transport media therebetween along a second path when the moveable frame is in a second position. Media transported by the apparatus are supported on a first side by the fixed belt and the moveable belt and rollers on the second side along at least a portion of the first and second paths.

32 Claims, 8 Drawing Sheets

CAPTURED BELT PATH SELECTION APPARATUS AND SYSTEM

TECHNICAL FIELD

The present invention relates to the field of conveying flat media, and particularly to the use of belt-type conveyors that capture mail items between opposed flexible belts to transport and direct mail items in processing operations.

BACKGROUND OF THE INVENTION

Apparatus and systems utilizing opposed "pinched" flexible belts for transporting and directing flat media such as currency, cards and similar items of generally uniform size are known. Such "pinched belt path" devices create a path or course formed by opposing flexible belts traveling in the same direction wherein media is captured between the belts and carried along the path or course defined by the belts. In such systems it is often necessary to direct the media to (1) one of several selected diverging paths or (2) from one of a plurality of converging paths to a single path. In practice this is not a trivial task.

Transport devices using pinched belts to "capture" both sides of transported media must keep the media captured between the belts at all times in order to avoid having the media change speed, jam or become skewed with respect to the belt path. However, in most, if not all, pinched belt applications the media must be temporarily released from between the belts at some time to accomplish certain functions. It may be necessary to temporarily release the media when the media must pass a vision or scanning system to enable reading of indicia from the media's surface. Likewise, it may be necessary to combine multiple media streams into a single stream with a converging path device, or direct media along one of a number of different paths in a diverging path device. In these instances, the media must typically be transferred from one set of opposed or pinched belts to another.

Current methods of diverting media "captured" or pinched between opposing flexible belts typically involves the use of a knife-like gate that is moveable between two or more positions to divert media items along one of several selected paths. Such a device is described in U.S. Pat. No. 5,536,002 which discloses a conveyor for conveying paper sheets including a three way directional switching unit. The directional switching unit includes conveyor belts for conveying cash bills, sheet guides associated with the conveyor belts to guide the bills and a gate for directing the cash bills. The gate is formed in the shape of a triangle and mounted on a plate that moves in a circular fashion so as to move the gate through an eccentric path, thereby changing the path of bills moving through the unit.

To direct items from multiple paths to a single path, current methods typically rely on stationary sheet guides to direct media received from multiple conveyors, each comprising a pair of opposed belts forming a pinched belt path, to a single such conveyor. In each of these cases, prior art devices relinquish control, i.e., the media is released from between belts, for some distance or period. As noted above, releasing the media in this manner entails a risk that the media will skew, jam or both.

Thus, there is a need for an improved apparatus for directing media, such as mail items, paper sheets and the like along converging and/or diverging paths.

SUMMARY OF THE INVENTION

In one embodiment the invention comprises a pinched belt conveyor system for transporting flat media along converging or diverging paths. The system includes at least one fixed, vertically oriented belt and at least one moveable selector belt for transporting media therebetween. The moveable belt may be shifted between a first position wherein media received between the fixed belt and moveable belt is transported from one of a plurality of converging paths to a single path, or from a single path to one of a plurality of diverging paths and a second position where the moveable belt is positioned away from the fixed belt. The moveable belt is offset vertically from the fixed belt so that the moveable belt may pass above the fixed belt when moved horizontally from the first position to the second position. Alternatively, the moveable belt may be configured so as to move below the fixed belt when moved from the first position to the second position.

In one aspect the movable selector belt is mounted on a first, moveable frame while the fixed belt is mounted on a second fixed frame. In this aspect the moveable frame includes parallel bottom and top support members and a plurality of uprights configured to move in slots in the fixed base frame. A plurality of guide rollers are mounted on parallel support members opposite the selector belt and are vertically offset from the moveable belt. In operation, flat media items, such as mail pieces transported between the fixed belt and moveable belt are supported on a first side by the fixed belt and on the second side by the moveable belt and one or more guide rollers.

In another aspect the invention includes a conveyor apparatus having a first fixed frame including a plurality of fixed, vertically oriented flexible belts mounted thereon and a second moveable frame including a plurality of vertically oriented selector belts mounted thereon. The movable frame includes a pair of parallel supports between which the fixed frame is disposed. At least a first one of the moveable belts and a fixed belt transport media therebetween along a first path when the moveable frame is in a first position and at least a second one of the moveable belts and a fixed belt transport media therebetween along a second path when the moveable frame is in a second position. In this aspect, one of the movable belts passes through the first path when the moveable frame is moved from a first position to the second position. The apparatus can transport media from one of: (1) a first one of a plurality of converging paths to a single path, and (2) from a single path to a first one of a plurality of diverging paths when the moveable frame is in a first position depending upon the direction of travel of the belts. In a second position the apparatus can transport media between at least one of the fixed belts and at least one of the moveable belts from one of: (1) a second one of a plurality of converging paths to a single path, and (2) from the single path to a second one of the plurality of diverging paths, again, depending upon the direction in which the belts are traveling.

In another aspect, the invention comprises a conveyor system, including a first pair of fixed conveyor belts positioned to engage a flat item therebetween and transport the flat item along a main conveyor path, a second pair of fixed conveyor belts positioned to engage a flat item therebetween and transport the flat item along a first branch path and a third pair of fixed conveyor belts positioned to engage a flat item therebetween and transport the flat item along a second branch path. A first moveable belt can be positioned in alignment with one of the fixed belts to form a first divert path that transports the item from the main path to the first branch path and a second moveable belt can be positioned in alignment with a second one of the fixed belts to form a second divert path that transports the item from the main path to the second branch path. The first and second moveable belts are mounted on a common frame and move in tandem, such that moving the first moveable belt out of the first divert moves the second moveable belt into the second divert path. The first and second moveable belts are also laterally offset form the fixed belts, so that each movable belt can move into and out of the divert paths without interference with any of the fixed belts. During transport of a flat item, the movable and fixed belts engage opposite side portions of the flat item during movement of through the divert paths. In this aspect, the conveyor system includes a controller that receives signals indicating which branch path an item should be diverted to and means responsive to signals from the controller for moving the movable belts to form the first or second divert path as the item passes out of the main conveyor path into one of the divert paths.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Figure 1:
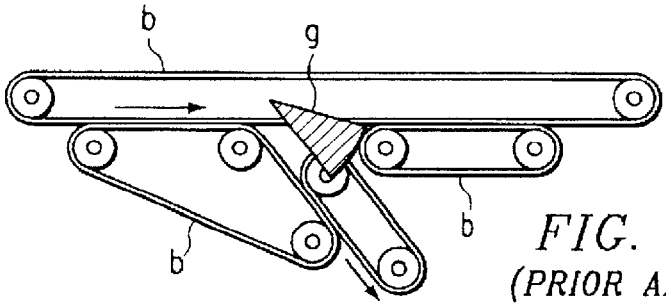
FIG. 1 (PRIOR ART)
FIGS. 1–3 are schematic illustrations of prior art devices for conveying media comprising flat articles such as mail through converging or diverging paths.
Figure 2:
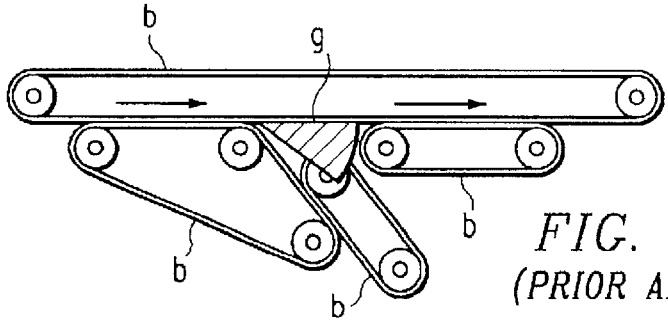
FIG. 2 (PRIOR ART)

Turning now to FIGS. 1 and 2, there is shown a prior art diverging path pinched belt media transport in which media such as sheet paper, currency or letters travel through the transport in the direction indicated by the arrows. In FIG. 1, moveable gate g is in a first position, intercepting and directing media in the indicated direction along a first path. In FIG. 2, moveable gate g is shown in a second position, allowing media to travel through the transport along a second path.

Figure 3:
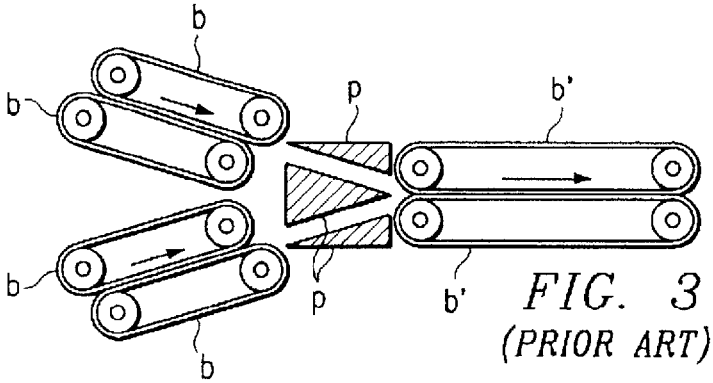
FIG. 3 (PRIOR ART)

FIG. 3 shows a conventional converging path pinched belt prior art transport. As shown, media enters the transport from the right conveyed by one of two pinched belt conveyors, each comprising a belt pair b—b. Media from either of the two converging conveyors is guided by sheet guides p between the belts of a third conveyor b'—b' for transport along a single belt path.

The foregoing media transport devices release media being transported from between opposes belts for some distance and are therefore subject to jamming as well as allowing the the media change speed or become skewed relative to the transport path. This is especially the case with non-homogeneous media, such as letter mail, that may vary in size and thickness.

Figure 4:
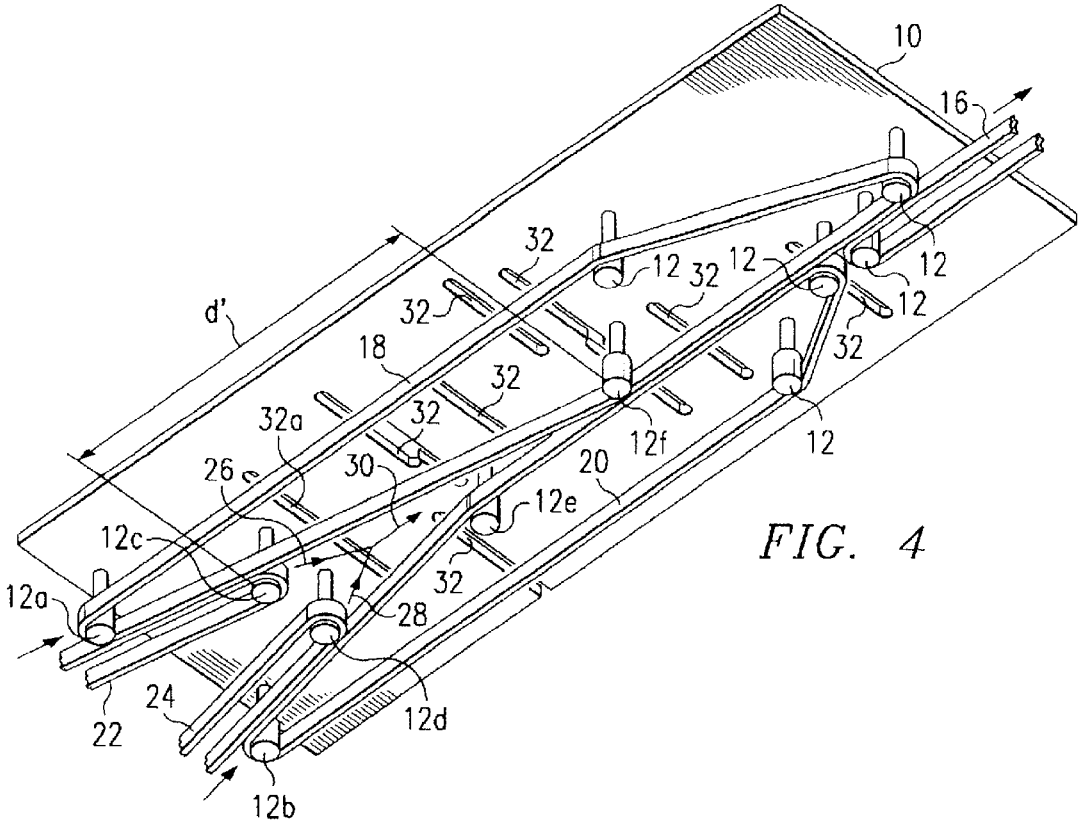
FIG. 4 is a perspective of a base plate in accordance with one aspect of the invention including a plurality of fixed belts mounted thereon and a plurality of slots formed therein.

Turning now to FIGS. 4–8 there is shown a binary captured belt path selection device 8 including base frame or baseplate 10 and a selector frame 40. As best shown in FIG. 4 a plurality of spaced apart fixed rollers 12 are mounted on and perpendicular to plate 10 with shafts 14 (FIG. 8) fixed to the base plate. Rollers 12 carry fixed position belts 16, 18, 20, 22 and 24 which are conventionally driven with motors, either directly or through a belt, chain or other drive system (not shown). Fixed belts 16–24 are vertically oriented or perpendicular to base plate 10. Typically, each of fixed rollers 12 is positioned at a height above base plate 10 corresponding to approximately one half of the average height of the media to be conveyed by the path selection device. In the illustrated embodiment, rollers 12 are positioned in a spaced apart relationship, the distance between the rollers being a function of the particular design and application. Base plate 10 also includes a plurality of transverse slots 32, each extending partially across the baseplate. As shown, rollers 12 and belts 16–24 define a converging (or diverging) generally Y shaped course having legs 26, 28 and 30 for transporting media such as letter mail on edge between opposed belts. Media entering the transport from the right traveling along belt paths corresponding to legs 26 and 28 will converge into a single path corresponding to leg 30. However, in traversing the path between converging legs 26 or 28 and leg 30 using only fixed belts 16–24 mounted on baseplate 10, the individual flats or media items, for example sheets of paper or envelopes, would travel uncontrolled over the distance or interval between rollers 12(*c*) or 12(*d*) and roller 12 (*f*), respectively, allowing the media to jam or skew.

Figure 5:
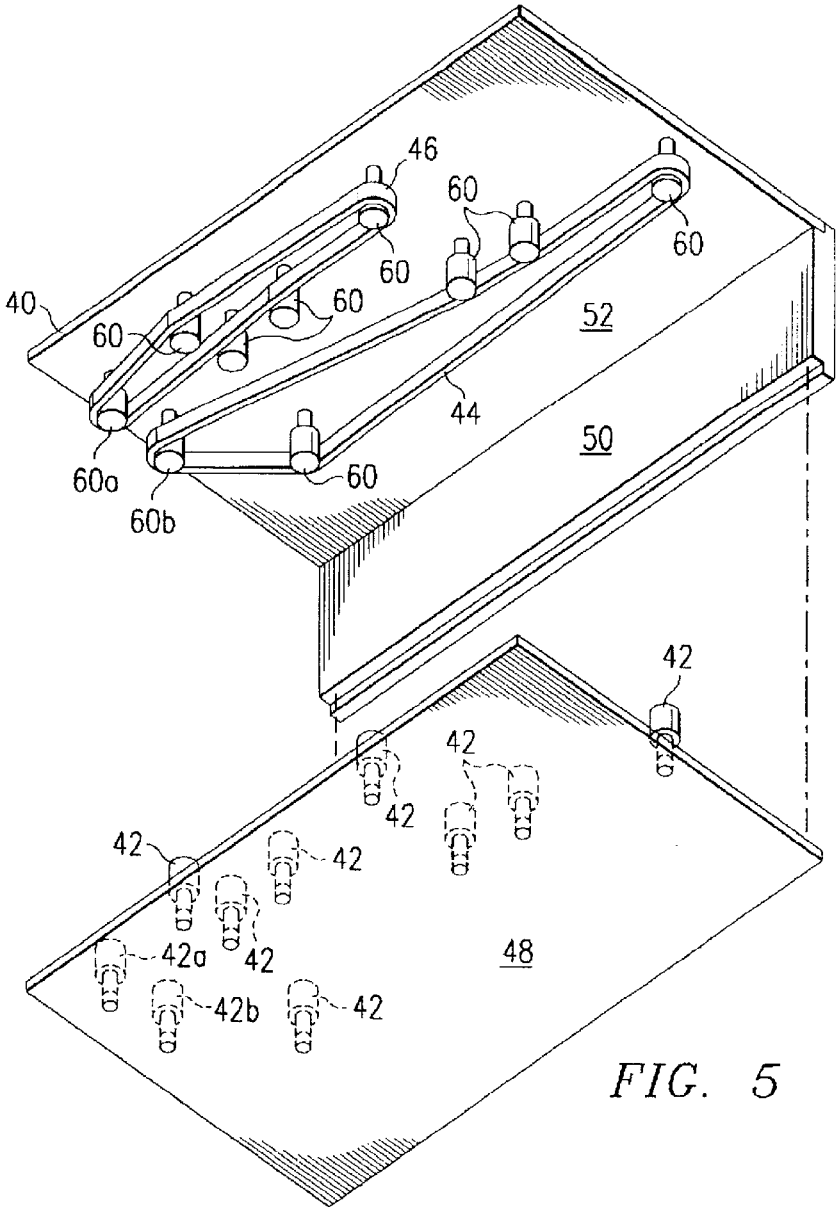
FIG. 5 is an exploded view of a moveable selector frame configured for use with the base plate of FIG. 4 including a plurality of selector belts and guide rollers mounted on opposing sides of the frame.
Figure 8:
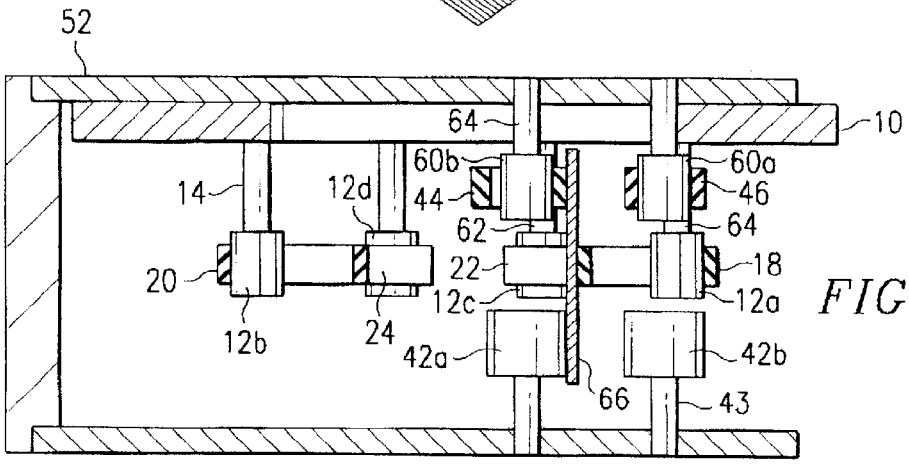
FIG. 8 is a partial cross sectional view taken along line 8—8 of FIG. 6.

Referring to FIGS. 5 and 8 a moveable path selector frame 40 includes a belt carrier plate 52, side plate 50 and a roller carrier plate 48 extending parallel to belt carrier 52. A plurality of guide rollers 42 are mounted on roller carrier 48 and a plurality of belt guides 60 are mounted on belt carrier plate 52. Moveable selector belts 44 and 46 extend around belt guides 60 and are conventionally driven with motors, either directly, or with a known belt, chain or other drive system. In the illustrated embodiment, selector belts 44, 46 are termed moveable insofar as the belts move with frame 40. Although as illustrated, belts 44, 46 move with frame 40, it is contemplated that means other than a moving frame may be use to position belt guides 60 and selector belts 44, 46 such as a combination of slides, rails and actuators mounted on a fixed selector frame.

Figure 6:
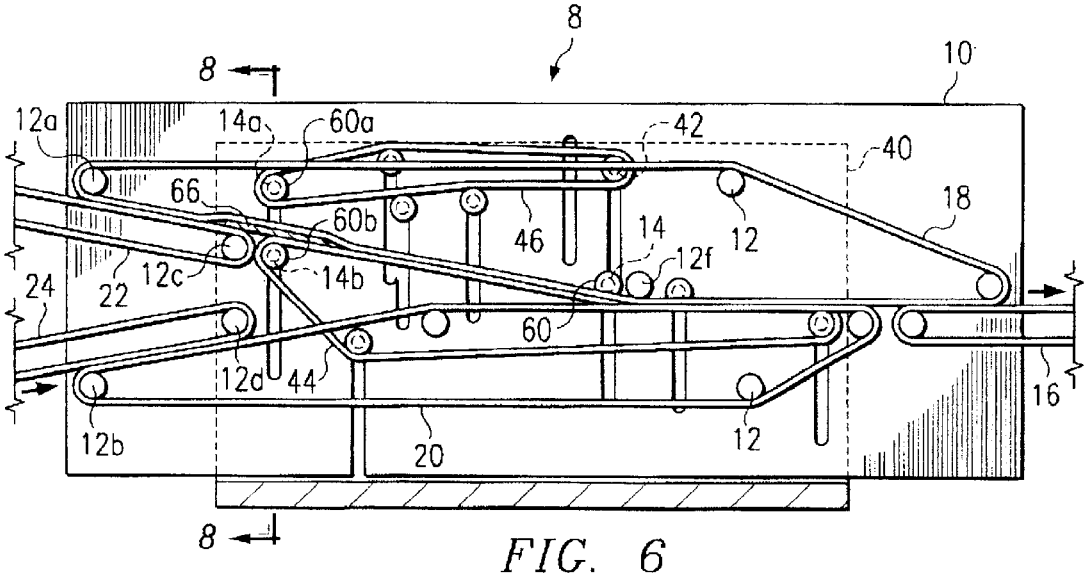
FIG. 6 is a partial view of a selector device according to the invention including the base plate of FIG. 4 assembled with the selector frame of FIG. 5, the selector frame being in a first position corresponding to FIG. 10.
Figure 7:
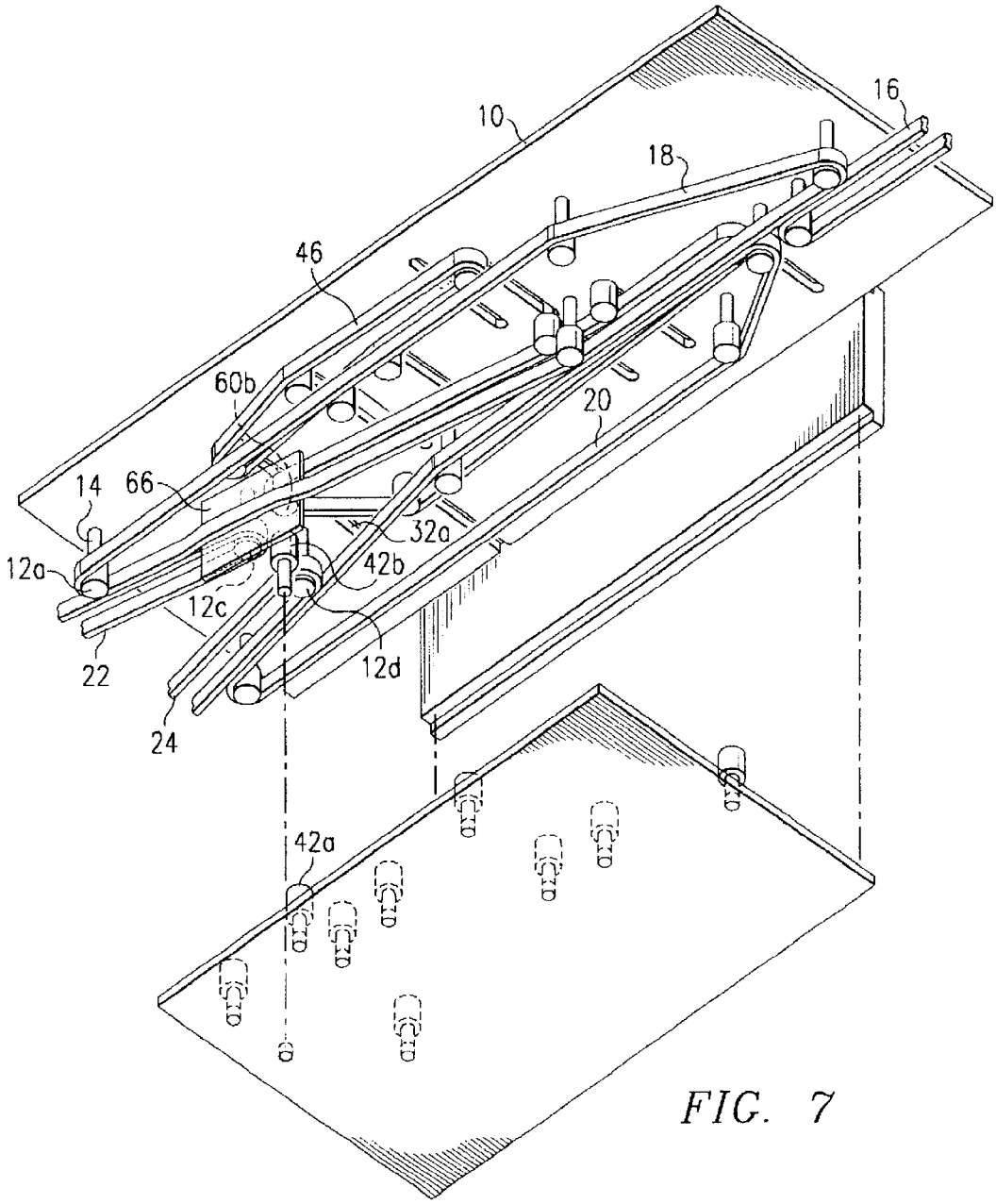
FIG. 7 is a perspective view of the selector device of FIG. 6.

Turning now to FIGS. 6–8 selector frame 40 fits over base plate 10 in a first position with base plate 10 positioned between belt carrier plate 48 and roller carrier plate 52. Selector frame 40 may be supported for movement relative to base plate 10 in any conventional manner for example with side rails or rollers (not shown). As best shown in FIG. 8, belt carrier 52 is positioned immediately adjacent to base plate 10 with shafts 64 of belt guides 60 extending through slots 32 in base plate 10. Extending from and perpendicular to roller carrier 48 are a plurality of guide rollers 42, each mounted on shaft 43. As illustrated in FIG. 8, roller carrier 48 and guide rollers 42 are configured and positioned so that the top of roller 42 is vertically offset from fixed belts 16–24, allowing roller 42 to pass fixed belts 16–24 without interference when moved in a horizontal direction.

Extending perpendicular to and from belt carrier plate 52 of selector frame 40 are a plurality of belt guides 60, each including a shaft 62 and pulley 64 around which selector belts 44, 46 extend. Belt carrier plate 52 and belt guides 60 are horizontally positioned such that each selector belt 44, 46 are vertically offset from fixed belts 16–24, allowing selector belts 44, 46 to pass fixed belts 16–24 without interference when moved in a horizontal direction. In the illustrated embodiment, guide rollers 42 and belt guides 60 are positioned in pairs on selector frame 40, with a guide roller 42 aligned in vertically opposed relationship to each belt guide 60 in the selector frame. Since guide rollers 42, belt guides 60 and selector belts 44, 46 are vertically offset from fixed rollers 12 and corresponding fixed belts 16–24, guide rollers 42 and selector belts 44, 46 may pass one or more of fixed belts 16–24 when the selector frame 40 is moved relative to the base plate 10, for example from a first position shown in FIGS. 6–8 to a second position illustrated in FIGS. 9–11. As used herein, "pass" or "passing" refers to the movement of selector belts 44, 46 and guide rollers 42 above or below one or more of fixed belts 16–24 when selector frame 40 is moved from one position to another in a horizontal direction.

Figure 10:
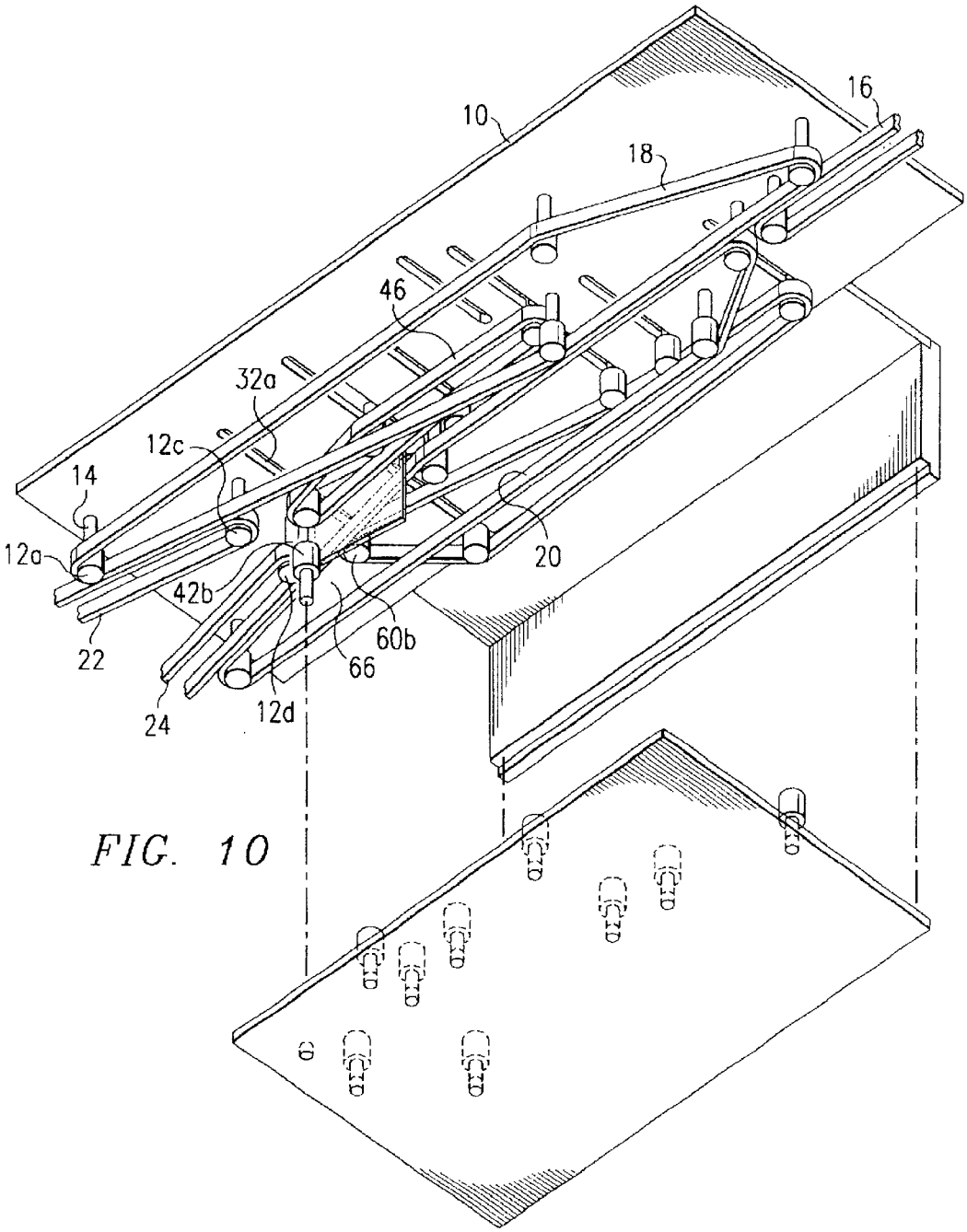
FIG. 10 is a perspective view of the selector device in the position shown in FIG. 9.

The geometry and positioning of moveable selector belts 44, 46 also allows a selector belt 44, 46 to overlap or track the same path a fixed belt 16–24 running traveling in the same direction, as illustrated in FIGS. 7 and 10. This arrangement smooths the transfer of media though the transition from one belt pair to another by keeping the media captured between belts, reducing the likelihood of jamming.

Referring now to FIGS. 6–8, the captured belt path selector 8 is situated in a first position wherein selector belt 44 tracks fixed belt 18 along a portion of its length, creating a pinched belt path corresponding to legs 26 and 30 of FIG. 4. In this position, media such as envelope 66 carried between fixed belts 18 and 22 is directed to a belt path formed by moveable belt 44 and fixed belt 18. The media is then transferred to the belt path formed by fixed belts 18 and 16 and discharged from the device as indicated by the arrows shown in FIG. 6.

Figure 9:
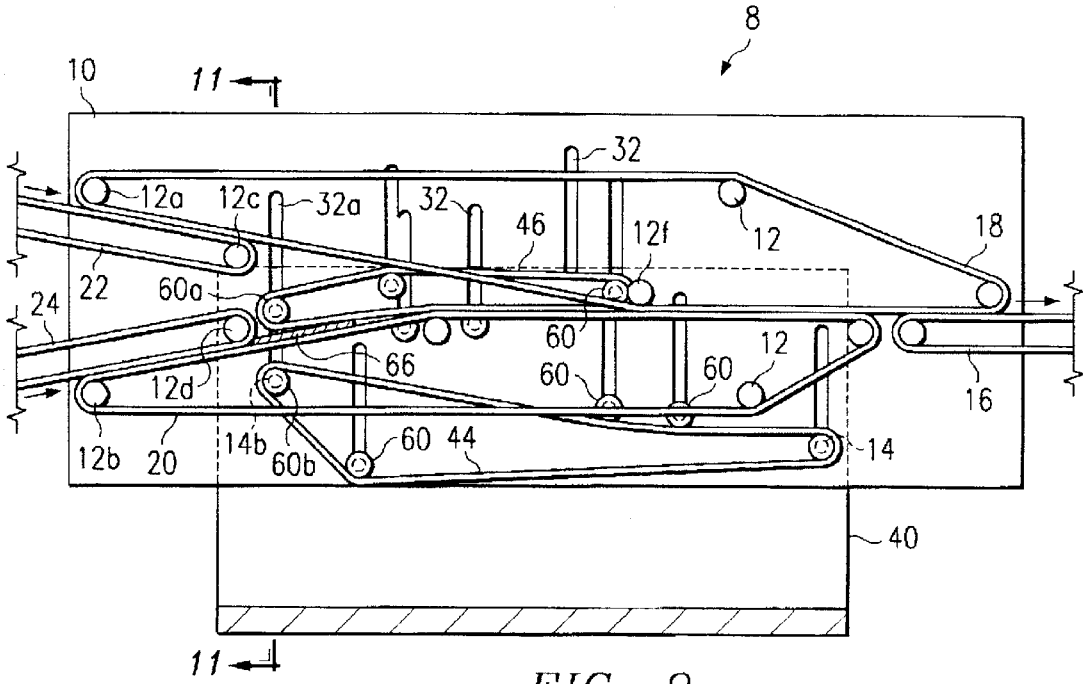
FIG. 9 is a partial view of a selector device according to the invention including the base plate of FIG. 4 assembled with the selector frame of FIG. 5, the selector frame being in a second position corresponding to FIG. 10.
Figure 11:
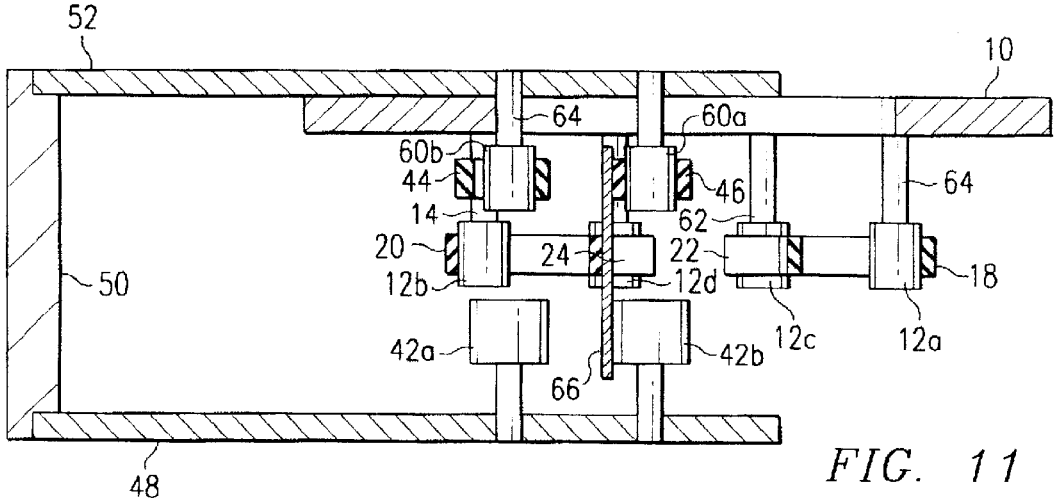
FIG. 11 is a partial cross section along line 11—11 of FIG. 9.

Turning to FIGS. 9–11, the selector device 8 is illustrated in a second position wherein frame 40 has been shifted to position moveable belt 42 adjacent to fixed belt 20. In this position, a flat media piece such as an envelope 66 traveling along this path is pinched between fixed belt 20 on one side and moveable belt 44 and roller 42(*b*) on the other side along the belt path extending from the end of belt pair 18, 22 to the point where the media is captured by belt pair 18, 20.

Figure 12:
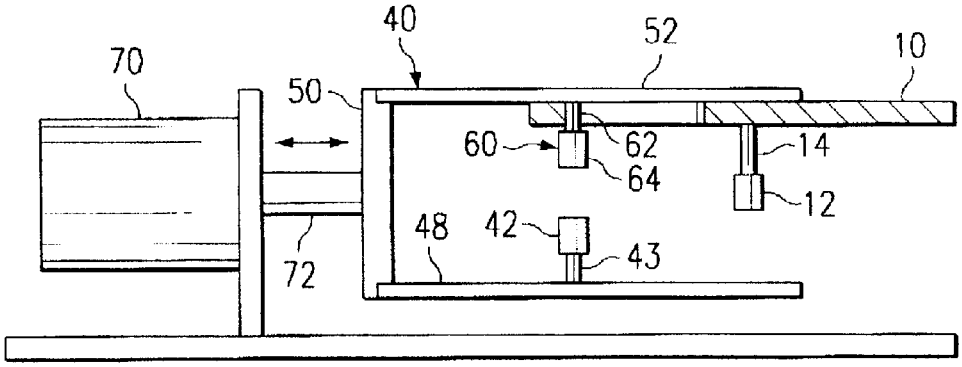
FIGS. 12–14 are schematic illustrations showing actuators for positioning the selector frame of the selector device of FIG. 6.
Figure 13:
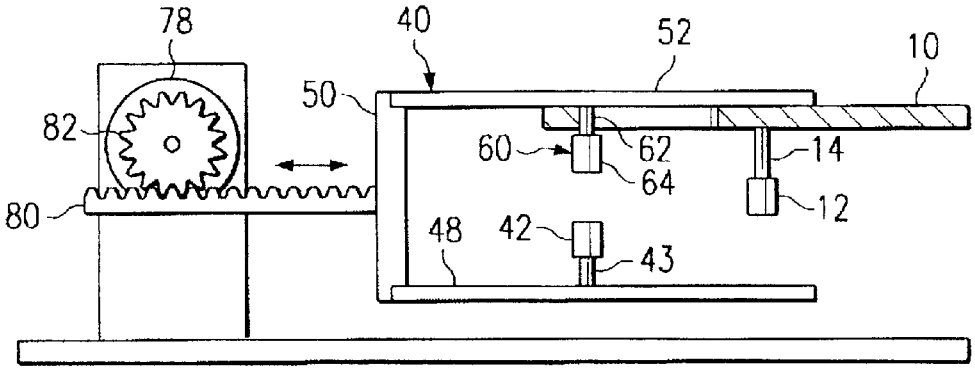
Figure 14:
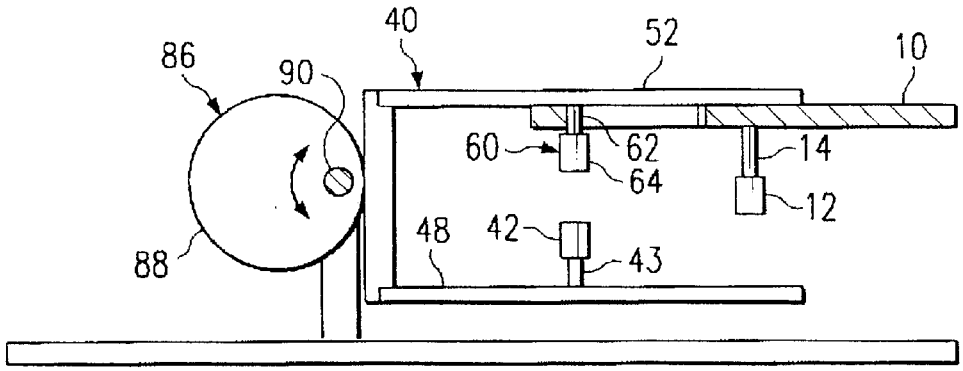

Referring now to FIGS. 9–11, captured belt path selector 8 is illustrated in a second position wherein selector belt 46 tracks fixed belt 20 along a portion of its length forming a pinched belt path. As will be appreciated, to move from the position in FIGS. 6–8 to the position shown in FIGS. 9–11, belt guide 60(*b*), selector belt 44 and guide roller 42(*b*) have moved across fixed belt 20 with guide roller 42(*b*) passing below fixed belt 20 and belt guide 60(*b*) and selector belt 44 passing above fixed belt 20. Selector frame 40 is moved between the position shown in FIGS. 6–8 and the position shown in FIGS. 9–11, with a linear actuator, (FIGS. 12–14). The actuator may be operated manually or by computer controlled, directing media in response to preprogramed instructions. In the position shown in FIGS. 9–11, a flat media piece such as an envelope 66 is pinched between fixed belt 18 on one side and moveable belt 46 and roller 42(*a*) on the other side along the portion of the belt path extending from the end of belt pair 20, 24 to the point where the media is captured by belt pair 18, 20.

As will be appreciated, the selector device illustrated in FIGS. 6–11 may be configured to direct media from a single path to two diverging paths by reversing the direction in which the belts are running. For example, selector frame 40 would be moved between the positions shown in FIGS. 6 and 9 to direct mail entering from the left along a path corresponding to leg 30 of FIG. 5 to one of the paths corresponding to legs 26 and 28 as desired. In this case, the selector frame could be selectively positioned to direct media to the selected path based upon or in response to input from, for example, a scanner or reader (not shown) such as a bar code reader or optical character recognition unit, reading a code or indicia appearing on individual media items.

Turning now to FIGS. 12–14 there are shown alternative actuators for positioning selector frame 40 in captured belt path selector 8. As illustrated in FIG. 12, actuator 70 comprises a linear acting cylinder 72 connected to upright 50 which may be a solenoid or a pneumatic or hydraulic cylinder. In some applications, a solenoid may not be capable of achieving the desired travel in which case a pneumatic or hydraulic cylinder will be preferable. In FIG. 13, actuator 78 comprises a rack and pinion drive, having a toothed rack or lead screw 80 connected to upright 50 and driven with a gear-type pinion 82 which may be powered by any conventional means such as an electric motor (not shown). FIG. 14 shows yet another alternative actuator 86 comprising a cam 88 driven on a shaft 90. Shaft 90 may be powered by any convention means such as an electric motor. It is contemplated that other conventional linear drive means such a timing belt type drive may be used to position selector frame 40 within captured belt path selector 8, depending upon the particular design and application. As will be appreciated, in operation, media pieces passing through selector 8 will have a tendency to force the belts between which the media is held, apart. Thus, the selected actuator is preferably capable of holding its position through the use of an internal or external latch, brake or similar means. It will also be appreciated that the configuration of selector 8 may be reversed insofar as the selector frame 40 could be fixed, and base plate 10 moveable to achieve the same result.

In an alternate embodiment of the captured belt path selector device 8, the device is configured without moveable belts 44, 46. In this embodiment, belt guides 60 are replaced with rollers 42 extending downwardly from roller carrier plate 48. Depending upon factors such as the length of media pieces to be processed, the speed at which the media pieces must be processed, roller spacing, and other considerations, additional rollers 42 may be required in addition to those shown in FIGS. 6–11, including the rollers used to replace the belt guides 60. In this embodiment, all or some of rollers 42 may be conventionally driven with one or more motors, either directly, or through a belt, chain or other drive system.

Figure 15:
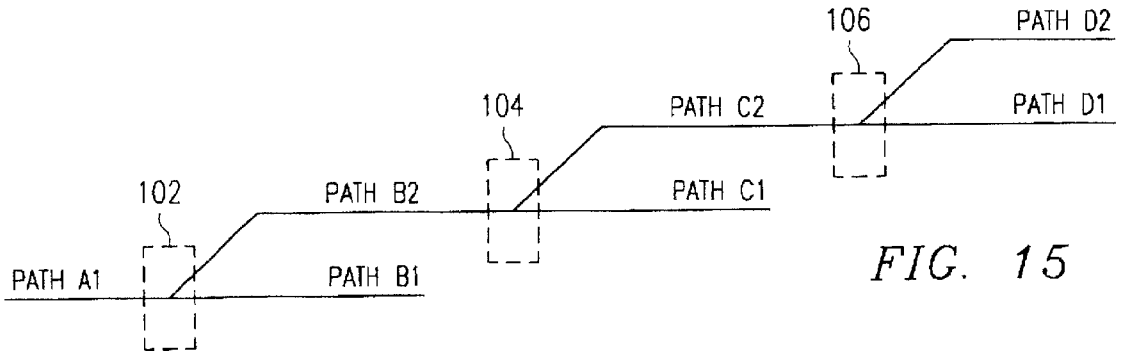
FIG. 15 is a schematic representation of a first alternate embodiment of the invention wherein a plurality of binary selectors are configured in series.

Turning now to FIG. 15 another embodiment of the invention is schematically illustrated. As shown, a stream of media on path Al may be directed to a plurality of different paths, B1, C1, D1 and D2 though the use of a series of binary captured path selectors 102, 104 and 106 such as the one illustrated and described in FIGS. 4–11. Conversely, media on a series of paths B1, C1, D1 and D2 could be converged into a single stream A1 using the same binary captured path selectors 102, 104 and 106 to merge the incoming streams of media.

Figure 16:
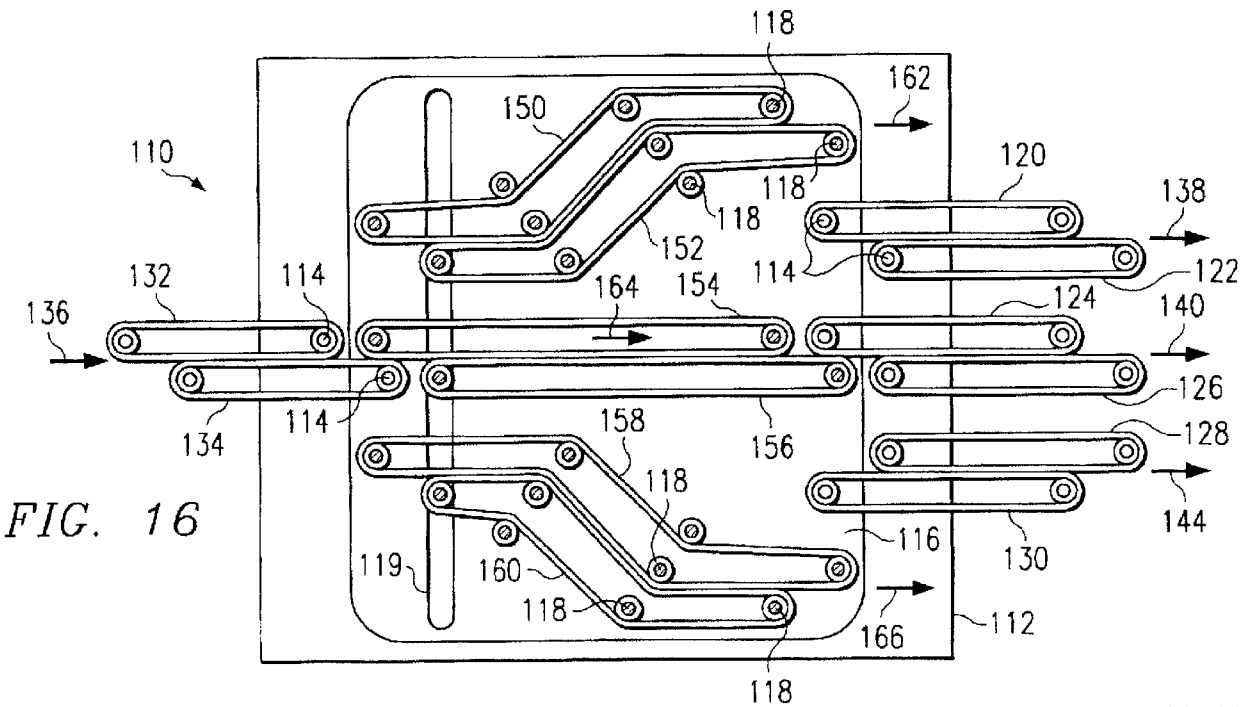
FIG. 16 is a schematic representation of a second alternate embodiment comprising a ternary captured belt path selector.

Referring now to FIG. 16 yet another embodiment of the invention is illustrated as an alternative to the successive binary devices of FIG. 3. A ternary path captured belt selection device 110 includes a base plate 112 with a plurality of fixed rollers 114 around which fixed belts 120 through 134 are positioned. As shown, fixed belt pair 132–134 define a single incoming pinched belt path 136, and each of belts pairs 120–122, 124–126 and 128–130 define one of three outgoing diverging belt paths 138, 140 and 144, respectively.

A moveable frame 116 includes a plurality of guide rollers (not shown) and belt guides 118 configured generally as shown in FIGS. 8 and 9. The guide rollers are also configured to move in slots 119 (one shown) in base plate 112 as described in connection with FIGS. 6–9, upon movement of frame 116. Moveable frame 116 may be moved and positioned with an actuator such as shown in FIGS. 10–12.

Positioned on belt guides 118 are a plurality of selector belts 150 through 160. As illustrated, selector belt pairs 150–152, 154–156 and 158–160 each define one of three moveable diverging belt paths 162, 164 and 166 respectively. In the position illustrated in FIG. 14, fixed incoming belt path 136 formed by fixed belts 132 and 134 is aligned with moveable belt path 164 which in turn is aligned with fixed outgoing belt path 140. To create a belt path from incoming belt path 136 to diverging path 138, frame 116 is shifted to align belt pair 150, 152 with fixed belt pair 132, 134 on the incoming side and belt pair 120, 122 on the outgoing side thereby aligning belt paths 136, 162 and 138. To form a belt path from incoming belt path 136 to diverging path 144, frame 116 is shifted to align belt pair 158, 160 with fixed belts 132, 134 and with fixed belts 128, 130. With frame 116 in this position, belt paths 136 and 160 are aligned to direct media to belt path 144. As will be appreciated, the direction of media flow could be reversed wherein ternary selector 110 could be utilized to direct media from a selected one of paths 138, 140 and 144 to path 136 with the belts operating in the opposite direction.

In the practice of the invention, various actuators, sensors, limit switches, computers, microprocessors and similar devices may used to control the operation of the captured belt path selector 8. For example, photocells may be used to monitor the passage of media items through the device and detect jams. Optical Character Recognition devices (OCR) maybe incorporated to read indicia appearing on media such as mail pieces. Proximity sensors and limit switches may be used to control and limit the travel of selector frame 40. All such additions and modifications are known to those of skill in the art.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A conveyor system for transporting flat media comprising:

at least one fixed conveyor belt and at least one moveable selector belt for transporting media therebetween, the moveable selector belt being movable between a first position wherein media received between the fixed belt and the moveable selector belt is transported from one of a plurality of converging paths to a single path and a second position, the moveable selector belt being offset from the fixed belt so that at least a portion of the moveable selector belt passes through at least one of the paths when the moveable selector belt is moved from the first position to the second position.

2. The conveyor system of claim 1 wherein the moveable selector belt is mounted on a moveable frame and the fixed belt is mounted on a fixed frame wherein the moveable frame is moveable between a first and second position to position the movable selector belt.

3. The conveyor system of claim 2 further comprising a plurality of guide rollers offset from the moveable selector belt wherein the fixed belt supports media being transported on a first side and the moveable selector belt and rollers support the media on a second side along at least a portion of the first path.

4. The conveyor system of claim 3 wherein the guide rollers are mounted on the moveable frame and are offset from the moveable selector belt.

5. The conveyor system of claim 3 wherein the moveable selector belt and at least one of the guide rollers move past the fixed belt on either side thereof when the moveable frame is moved from the first position to the second position.

6. The conveyor system of claim 1 further comprising:

a fixed frame supporting a plurality of fixed belts:

a movable frame, wherein a plurality of moveable selector belts mounted on the movable frame are offset from the fixed belts wherein at least one of the fixed belts and at least one of the moveable belts transport media therebetween from one of: (1) a first one of a plurality of converging paths to a single path, and (2) from a single path to a first one of a plurality of diverging paths when the moveable frame is in a first position and wherein at least one of the fixed belts and at least one of the moveable belts transport media therebetween from one of: (1) a second one of a plurality of converging paths to a single path, and (2) from the single path to a second one of the plurality of diverging paths when the moveable frame is in a second position; and at least one of moveable selector belts passing through at least one of the paths when the movable frame is moved from the first to the second position.

7. The conveyor system of claim 6 further comprising at least one guide roller offset from at least one of the moveable selector belts.

8. The conveyor system of claim 7 wherein a plurality of guide rollers are mounted on the moveable frame and offset from at least one of the moveable selector belts, the guide rollers supporting media being transported between the moveable selector belt and one of the fixed belts.

9. The conveyor system of claim 1 further comprising a actuator for moving the moveable selector belt from a first position to a second position.

10. The conveyor system of claim 7 wherein a least one of the moveable selector belts and at least one of the guide rollers move past at least one fixed belt on either side thereof when the moveable frame is moved from the first position to the second position.

11. A conveyor apparatus comprising:

a fixed frame including a plurality of fixed, flexible conveyor belts mounted thereon;

a moveable frame including a plurality of movable selector belts mounted thereon, wherein at least a portion of the fixed frame is disposed within the moveable frame, the moveable selector belts being offset from the fixed belts for movement past at least one of the fixed belts when the movable frame is moved from a first position to a second position;

at least a first one of the moveable selector belts and a fixed belt transporting media therebetween along a first path when the moveable frame is in a first position and at least a second one of the moveable belts and a fixed belt transporting media therebetween along a second path when the moveable frame is in a second position wherein at least one of the movable belts passes through one of the paths when the moveable frame is moved from a first position to the second position.

12. The conveyor apparatus of claim 11 further comprising a plurality of guide rollers offset from the moveable belt wherein the fixed belt supports media being transported on a first side and the moveable belt and rollers support the media on a second side over at least a portion of each of the first and second paths.

13. The conveyor apparatus of claim 12 wherein at least one of the moveable selector belts and at least one of the guide rollers are offset so that at least one fixed belt passes therebetween when the moveable frame is moved from the first position to the second position.

14. The conveyor apparatus of claim 11 wherein at least one of the fixed belts and at least one of the moveable selector belts transport media therebetween from a first one of a plurality of converging paths to a single path when the moveable frame is in a first position and from a second one of the plurality of converging paths to the single path when the moveable frame is in a second position.

15. The conveyor apparatus of claim 11 wherein at least one of the fixed belts and at least one of the moveable selector belts transports media therebetween from a single path to a first one of a plurality of diverging paths when the moveable frame is in a first position and from the single path to a second one of the plurality of diverging paths when the moveable frame is in a second position.

16. The conveyor apparatus of claim 11 wherein the moveable frame includes a pair of parallel supports and wherein the fixed frame is disposed between the supports.

17. The conveyor apparatus of claim 16 wherein the fixed frame comprises a plurality of slots and wherein the movable frame includes a plurality of uprights disposed between the parallel supports, the uprights connecting the bottom support and top support and being disposed in the slots for movement relative to the fixed frame.

18. The conveyor apparatus of claim 17 further comprising a plurality of guide rollers offset from at least one of the moveable selector belts wherein the guide rollers are mounted on one of the bottom and top supports and wherein the moveable selector belt is mounted on the other of the supports.

19. The conveyor apparatus of claim 18 wherein at least one of the moveable selector belts and at least one of the guide rollers are offset so that at least one fixed belt passes therebetween when the moveable frame is moved from a first position to a second position.

20. The conveyor apparatus of claim 19 wherein at least one of the fixed belts supports media being transported on a first side thereof and at least one moveable selector belt supports the media as the media is conveyed.

21. The conveyor apparatus of claim 11 wherein at least one of the moveable selector belts and a first fixed belt transport media therebetween along a first path when the moveable frame is in a first position and at least one of the moveable belts and a second fixed belt transport media therebetween along a second path when the moveable frame is in a second position, and wherein at least one of the movable belts passes through at least one of the paths when the moveable frame is moved from a first position to the second position.

22. A conveyor system for transporting flat media comprising:

at least one fixed, flexible conveyor belt and at least one moveable selector guide for transporting media therebetween, the moveable selector guide being movable between a first position wherein media received between the fixed belt and the moveable selector guide is transported from one of a plurality of converging paths to a single path and a second position, the moveable selector guide being offset from the fixed belt so that at least a portion of the moveable selector guide passes through at least one of the paths when the moveable selector guide is moved from the first position to the second position.

23. The conveyor system of claim 22 wherein the moveable selector guide is a guide roller mounted on a moveable frame and the fixed belt is mounted on a fixed frame wherein the moveable frame is moveable between a first and second position to position the movable selector guide.

24. The conveyor system of claim 23 further comprising a plurality of movable selector guide rollers offset from the moveable selector belt wherein the fixed belt supports media being transported on a first side and the moveable selector guide rollers support the media on a second side along at least a portion of the first path.

25. A conveyor system, comprising:

a first pair of fixed conveyor belts positioned to engage a flat item therebetween and transport the flat item along a main conveyor path;

a second pair of fixed conveyor belts positioned to engage a flat item therebetween and transport the flat item along a first branch path;

a third pair of fixed conveyor belts positioned to engage a flat item therebetween and transport the flat item along a second branch path;

a first moveable belt which can be positioned in alignment with one of the fixed belts to form a first divert path that transports the item from the main path to the first branch path;

a second moveable belt which can be position ed in alignment with a second one of the fixed belts to form a second divert path that transports the item from the main path to the second branch path.

26. The conveyor system of claim 25 further comprising a controller that receives signals indicating which branch path an item should be diverted to;

means responsive to signals from the controller for moving the movable belts to form the first or second divert path as the item passes out of the main conveyor path into one of the divert paths.

27. The conveyor system of claim 25 wherein the first and second moveable belts are mounted on a common frame and move in tandem, such that moving the first moveable belt out of the first divert moves the second moveable belt into the second divert path.

28. The conveyor system of claim 25 wherein the first and second moveable belts are laterally offset form the fixed belts, so that each movable belt can move into and out of the divert paths without interference with any of the fixed belts and the movable and fixed belts engage opposite side portions of the flat item during movement of through the divert paths.

29. A conveyor system for transporting flat items, comprising:

a belt conveyor including a single path and a pair of first and second converging paths adjoining the single path, the belt conveyor including first and second fixed belts which form part of the first and second converging paths, respectively;

a first movable belt movable into an operative position wherein a flat item received between the first fixed belt and the first moveable belt can be transported from the first converging path to the single path or from the single path to the first converging path;

a second movable belt movable into an operative position wherein a flat item received between the second fixed belt and the second moveable belt can be transported from the second converging path to the single path or from the single path to the second converging path; and a mechanism that moves one of the first and second movable belts into its operative position and moves the other of the first and second movable belts into an inoperative position.

30. The system of claim 29, wherein the mechanism that moves one of the first and second movable belts into its operative position comprises a movable frame on which the first and second belts are mounted in spaced apart positions.

31. The system of claim 29, wherein the first movable belt in its operative position grips the flat item at a position offset from the first fixed belt.

32. The system of claim 31, wherein the second movable belt in its operative position grips the flat item at a position offset from the second fixed belt.

* * * * *